United States Patent [19]

Kinnear

[11] 4,243,292

[45] Jan. 6, 1981

[54] LOW PROFILE BATTERY CONNECTOR

[75] Inventor: Joseph D. Kinnear, Western Springs, Ill.

[73] Assignee: Brad Harrison Company, LaGrange, Ill.

[21] Appl. No.: 73,606

[22] Filed: Sep. 10, 1979

[51] Int. Cl.[3] ..... H01R 11/28

[52] U.S. Cl. ..... 339/224; 339/227; 339/263 B

[58] Field of Search ..... 339/224–240, 339/263 B, 272 R

[56] References Cited

U.S. PATENT DOCUMENTS

| | | | |
|---|---|---|---|
| 2,142,759 | 1/1939 | Plachy | 339/227 |
| 2,684,991 | 7/1954 | Marks | 339/224 X |
| 3,922,058 | 11/1975 | Kinnear | 339/272 R |

*Primary Examiner*—Mark Rosenbaum
*Assistant Examiner*—Eugene F. Desmond
*Attorney, Agent, or Firm*—Mason, Kolehmainen, Rathburn & Wyss

[57] ABSTRACT

A connector for interconnecting a battery cable to a battery post or strap of an industrial battery or battery pack of an electrical vehicle or the like. A core assembly of copper includes a ring and a tube contacting one another with a point on the ring periphery adjacent one end of the tube and with the plane of the ring generally tangent to the tube. A body of lead partially encapsulates the core assembly and includes a washer-like portion surrounding the ring and a second portion surrounding one tube end. The other tube end extends from the body to form a cable receiving socket with which a clamping structure is associated so that subsequent cable replacement can be effected without replacement of the connector. Due to the orientation of the ring relative to the tube and the low profile of the washer-like body portion, the connector has wide applicability in providing a retrofit in many types of existing battery installations.

9 Claims, 7 Drawing Figures

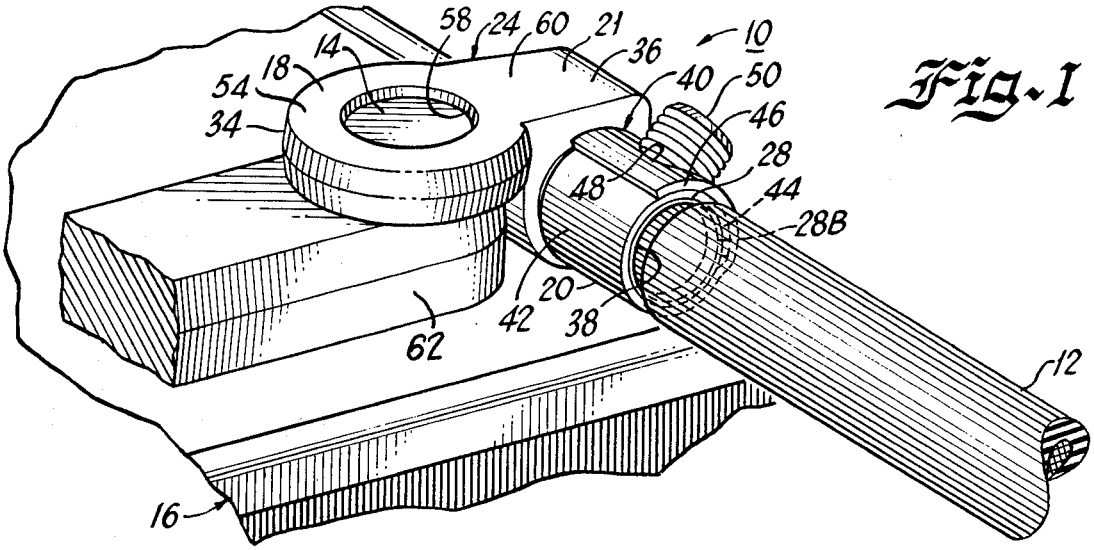
Fig. 1
Fig. 2
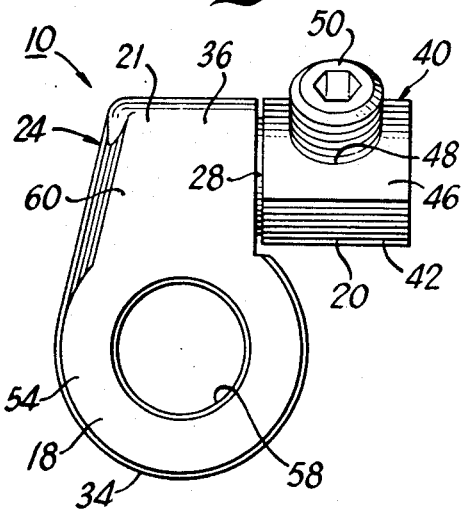
Fig. 3
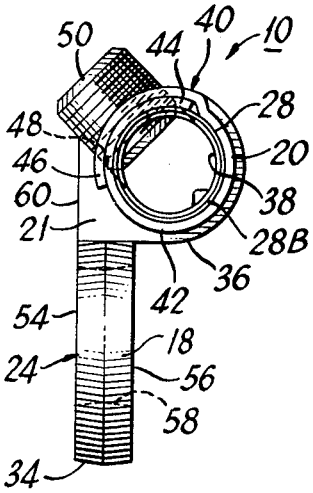
Fig. 4
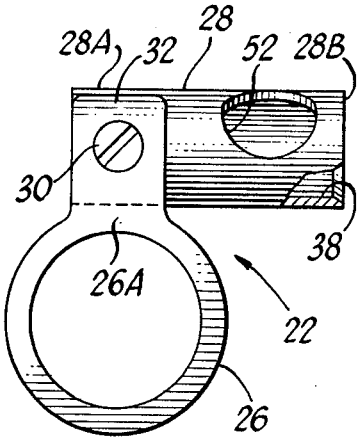
Fig. 6
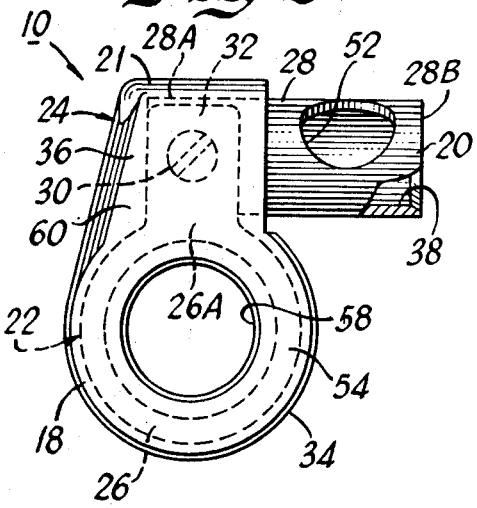
Fig. 7
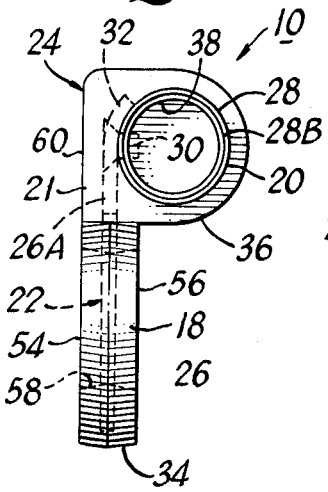
Fig. 5
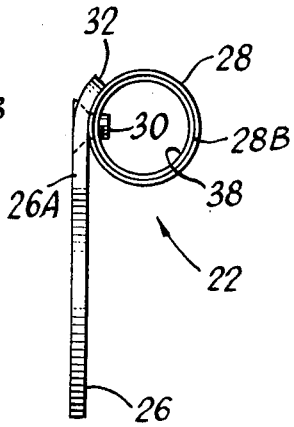

LOW PROFILE BATTERY CONNECTOR

The present invention relates to electrical connectors and more particularly to improvements in connectors for interconnecting a battery component such as a terminal post or strap to a battery cable.

In industrial battery installations, one example being electrically powered vehicles, battery cables are typically employed to interconnect the battery or battery pack with electrically powered equipment such as a vehicle drive system. Cable connectors attached to the cable ends distant from the battery are typically used for this purpose. For periodic recharging of the battery or battery pack, the cable connectors are disconnected from the drive system or other equipment and connected instead to a battery charger.

Periodic replacement of the battery cables is necessary, one reason being wear of or damage to the releasable cable connectors used selectively to interconnect the cables with the charger or drive system. Even if a cable connector is replaced without replacing the cable, this may require trimming or shortening of the cable end distant from the battery, and can only be done a limited number of times before the cable becomes too short and must be replaced.

Battery connectors used in the past have rendered the replacement of battery cables a difficult task requiring a high level of skill and requiring an inventory of different connectors for different battery installations. Typical battery connectors have included a first connector portion for attachment to a battery terminal post or having a strap extending between a number of battery posts. A second portion of the typical connector includes a contact structure, usually a crimp contact, for attachment to the battery cable. The connector is attached to a battery post by an intermetallic bond achieved by burning the connector in place so as to puddle the lead of the connector and post.

Cable replacement with such known connectors requires that a new battery connector similar to the original be available. This may necessitate a large inventory of parts, since widely different connector and strap configurations are used for different battery installations. The original connector must be removed, and the new connector with the new cable must be installed by a burning operation requiring care, skill and experience. Undesirable down time of the battery powered equipment can result if available maintenance personnel are unable to perform this task.

Among the important objects of the present invention are to provide an improved battery connector; to provide a connector which can be conveniently attached to many types of existing battery installations; to provide a connector which permits easy subsequent cable replacement; to provide a connector capable of being attached to existing battery installations without the necessity for removing existing connectors or straps; and to provide a connector overcoming disadvantages of battery connectors used in the past.

In brief, in accordance with the above and other objects of the present invention there is provided a battery cable connector including a body formed of lead partially encapsulating a core assembly formed of copper. The core assembly includes a ring and a tube. The ring and tube are in contact, with a point on the ring periphery adjacent one end of the tube and with the ring lying in a plane generally tangent to the tube. The body of lead includes a first washer-like portion enclosing the ring and defining a battery post receiving opening. The washer-like portion is of small vertical height and is smaller than the inside diameter of the tube. The body of lead includes a second portion integral and homogeneous with the washer-like portion and enclosing the one end of the tube. The other end of the tube extends from the second body portion to define a cable receiving socket.

The present invention together with the above and other objects and advantages may be best understood from the following detailed description of the embodiment of the invention shown in the accompanying drawing, wherein:

FIG. 1 is a perspective view of a part of a battery installation including a battery connector constructed in accordance with the present invention;

FIG. 2 is a top view of the connector;

FIG. 3 is a side view of the connector;

FIG. 4 is a top view of the core assembly of the connector;

FIG. 5 is a side view of the core assembly;

FIG. 6 is a top view of the connector with the encapsulated portion of the core assembly shown in broken lines; and FIG. 7 is a side view of the connector with the encapsulated portion of the core assembly shown in broken lines.

Having reference now to the drawing, there is illustrated a battery connector constructed in accordance with the principles of the present invention and generally designated by the reference character 10. The connector 10 is used for interconnecting a battery cable 12 with one or more terminal posts 14 associated with a battery installation comprising a storage battery or battery pack, only a portion thereof being illustrated in the drawing and generally designated by the reference character 16. In general, the connector 10 includes a first portion or contact 18 adapted for connection to a battery post 14 or other battery component and a second portion or contact structure 20 adapted for interconnection with an end of the battery cable 12. The connector 10 includes a hub or interconnecting portion 21 between the contact portions 18 and 20.

Proceeding to a more detailed description of the connector 10 of the present invention, the connector includes a core assembly designated as a whole by the reference character 22. The core assembly 22 is formed of a relatively strong and highly electrically conductive metal, preferably copper, and is partially encapsulated in a body of corrosion resistant and electrically conductive metal, preferably antimony lead, this body being designated as a whole by the numeral 24.

Advantageously the connector 10 has an extremely low profile or vertical height and this is made possible by the orientation of the portions of core assembly 22. The assembly 22 includes a conductor ring 26 as well as a tube 28. One point 26A along the periphery of the ring 26 is adjacent a first end 28A of the tube 28. Moreover, the ring 26 lies in a flat plane, and this plane is substantially tangent to the tube 28. The axis of the ring and the axis of the tube therefore extend in transverse directions and the axis of the tube is offset from the plane of the ring.

In order to provide a low resistance current path between the connector contact portions 18 and 20 and to strengthen the connector 10, the ring 26 and tube 28 are attached to one another. In the illustrated embodiment of the invention, the interconnection is accomplished by means of a screw fastener 30. The ring 26 at the region of the peripheral point 26A is provided with a radially extending tab 32. The tab overlies a segment of the wall of the tube 28 at the tube end 28A and is preferably curved intimately to overlie the tube wall. The fastener 30 extends through the tab 32 and is threaded into the wall of the tube 28 to assure firm mechanical and electrical contact.

For corrosion resistance, the battery terminal post 14 and other exposed current carrying battery components are normally formed of and/or coated with lead. For the same purpose and to permit an intermetallic connection between the post 14 or other component and the connector 10, the core assembly 22 is partially encapsulated in the body 24 of lead. This body includes a first, washer-like portion 34 entirely surrounding the conductor ring 26. A second portion 36 of the body 24 defines the hub portion 21 and encapsulates the tube end 28A as well as the region of contact between the ring 26 and the tube 28. Body portion 36 thus encloses the tab 32 and fastener 30 as well as the tube end 28. Furthermore, the body portion 36 may, if desired, fill the interior of tube 28 in the region of the tube end 28A.

An opposite end 28B of tube 28 extends from the portion 36 of the body 24 and defines a socket 38 for receiving the end of battery cable 12. A clamping structure generally designated as 40 is associated with tube end 28B for releasably holding and establishing a reliable, low resistance electrical connection to cable 12. Preferably the tube 28 is plated with lead so that the extending end 28B is resistant to corrosion.

Clamping structure 40 includes a tubular clamping member 42 in the form of a metal strip having overlapping end segments 44 and 46. A threaded opening 48 extends radially through the overlapping end segments 44 and 46 and receives a threaded clamping screw 50. The wall of the tube end 28B includes an opening 52 permitting the clamping screw 50 to enter the socket 38.

In order to connect battery cable 12 to the contact portion 20 of the connector 10, the clamping screw 50 is withdrawn or loosened to permit insertion of the trimmed end of cable 12 into the socket 38. Thereafter, the clamping screw 50 is tightened securely to clamp the cable end in position and to establish a reliable, high capacity, low resistance electrical connection between the cable 12 and the connector 10. The connector 10 may be used with battery cables of a range of sizes, and it may be desirable to employ a saddle or insert member within the socket 38 together with the cable end. The connection including the socket 38 and clamping structure 40 may be similar to those disclosed and claimed in U.S. Pat. No. 3,922,058 issued to Joseph D. Kinnear on Nov. 25, 1975. The disclosure of that patent is incorporated herein by reference and may be consulted for further information concerning the construction and the operation of the electrical connection.

The low profile of the connector 10 has important advantages in the use of the connector. The low profile is made possible by the configuration of the core assembly 22 and of the contact portions 18 and 20 and the hub portion of the connector 10 as well as by the size and orientation of the contact portions 18 and 20. The height or vertical thickness of the washer-like portion 34, defined between its upper wall 54 and lower wall 56, is quite small. This vertical distance is smaller than the diameter of the socket 38 and is less than one-half of the diameter of the battery terminal post receiving opening 58 defined by the washer-like portion 34.

Moreover, the vertical dimension of the washer-like portion 34, i.e. the height of the post contact portion 18 of the connector 10, is offset from the necessarily larger vertical height of the hub portion 21 and cable contact portion 20. Thus, the upper wall 54 of the washer-like portion 34 coincides with an upper wall 60 of the hub portion 21. The height of the washer-like portion 34 is preferably less than one-third of the vertical height of the hub portion 21, which is the overall maximum height of the connector 10.

As a result of these relationships and the low profile of the connector 10, minimal clearance is required for attachment of the connector 10 to the battery installation 16. Although the connector 10 necessarily includes a relatively larger overall height, it is only the height or vertical thickness of the battery post contact portion 18 which must be accommodated when the connector 10 is installed.

The important advantages of the connector 10 are realized when the connector is attached to the battery installation 16. Although the connector 10 is suited for installation as original equipment on a storage battery or battery pack, it has particular utility as a retrofit item when cable replacement is necessary in the field. This type of installation is illustrated in connection with the battery installation 16.

The installation 16, shown only in part, is representative of a typical battery installation and includes one or more terminal posts 14 with which there is associated an existing battery component 62. The component 62 might be an existing battery connector formerly associated with a battery cable to be replaced. Alternatively, the component 62 may comprise a strap extending between a pair of battery terminal posts 14.

When installed as original equipment, the post contact portion 18 of the connector 10 is simply installed with the post 14 received within the opening 58 of the connector. The connector is then burned in to puddle the lead of the post 14 and of the washer-like body portion 34 to create an intermetallic bond. A similar procedure may be followed in an existing installation if the post 14 extends sufficiently above the pre-existing component 62 or if a pre-existing battery connector is removed from the post 14.

In accordance with an important feature of the present invention, it is not necessary for installation of the connector 10 that a pre-existing connector or component 62 be removed, nor that the existing terminal post 14 extend above the existing component 62. The low vertical profile of the connector 10 permits it to be readily installed above an existing strap or connector, and the minimal increase in overall height of the installation does not prevent use of the connector 10 in close quarters or small battery compartments often encountered in the field.

More specifically, and as illustrated in the drawing, the post contact portion 18 of the connector 10 may be installed with the low profile washer-like part 36 overlying an existing post or strap or other component 62. Also, it may be installed in any desired position, either directly over a post as illustrated or at another point along the strap or component 62. For such an installation, the post contact portion 18 is placed in position and a burning in operation is carried out in which additional lead material may be added to fill the post receiving opening 58 of the washer-like body portion 34.

In this type of installation, the vertical offset of the hub 21 and cable contact portion 20 of the connector 10 is advantageous. Because the washer-like portion 34 is received above an existing post 14 and/or component 62, clearance is provided below the lower wall 56 in which these components of larger vertical height can readily be received.

One advantage of the connector 10 of the present invention is that due to its universal installation capability, it is not necessary to maintain a large inventory of different battery connector parts. It may be desirable to provide the connector 10 not only in the illustrated right hand orientation, but also in an alternative left hand orientation wherein the socket 38 extends in the opposite direction from the hub portion 21. With only these two connector versions, convenient attachment to a very wide variety of battery installations is possible.

Another important advantage of the connector 10 is realized after its initial attachment in a battery installation 16. When replacement of the battery cable 12 is once again required in the future, this is accomplished simply by releasing the cable end from the cable contact portion 20 through the release of the clamping structure 40. A new cable is trimmed and inserted and clamped in place, and the cable exchange is made quickly and easily. The necessity for further burning in operations with the consequent cost and possible down time is avoided.

The connector 10 illustrated in the drawings is intended to accommodate a standard battery terminal post 14 having a nominal diameter of 0.875 inch. In this preferred embodiment of the invention, the following nominal or approximate dimensions are employed. These dimensions are intended to be illustrative of the invention, and not to limit the scope thereof except as set forth in the accompanying claims.

vertical height of washer-like portion 34: 0.375 inch
overall vertical height of connector 10: 1.107 inch
diameter of opening 58: 0.875 inch
outside diameter of washer-like portion 34: 1.667 inch
diameter of socket 38 and inside diameter of tube 28: $\frac{5}{8}$ inch
offset of axis of tube 28 and axis of ring 26: $1\frac{1}{8}$ inch.

Terms such as "upper", "lower", "vertical" and the like are used herein to facilitate an understanding of the invention and should not be understood to limit the scope of the invention nor to imply that the connector 10 could not be installed in orientations other than that illustrated in the drawing.

While the invention has been described with reference to details of the illustrated embodiment, such details are not intended to limit the invention as defined in the following claims.

What is claimed and desired to be secured by Letters Patent of the United States is:

1. A battery cable connector comprising a body formed of lead and partially encapsulating a core assembly formed of copper, the core assembly including a ring and a tube contacting one another with a point on the ring periphery adjacent one end of the tube and with the ring lying in a plane generally tangent to the tube, said body including a first washer-like portion entirely enclosing said ring and defining a battery post receiving opening, the thickness of said washer-like portion being smaller than the inside diameter of said tube, said body including a second portion integral and homogeneous with said first portion enclosing said one end of said tube, the other end of said tube extending from said second body portion to define a cable receiving socket.

2. The connector of claim 1, said washer-like portion and said second portion of said body having a common upper wall, and said second portion having a height more than double the height of said washer-like portion.

3. The connector of claim 1, said tube being plated with lead.

4. The connector of claim 1, said ring including a radially extending tab located at said point on the ring periphery and overlying said tube.

5. The connector of claim 4, further comprising a fastener joining said tab and the wall of said tube.

6. The connector of claim 1, said second body portion filling the interior of said one end of the tube.

7. The connector of claim 5, said second body portion filling the interior of said one end of the tube and surrounding said fastener.

8. The connector assembly of claim 1 further comprising a tubular clamping member surrounding said socket formed as a metal strap having overlapped ends, an opening in the wall of said tube, an aligned opening extending radially through said overlapped ends, and a clamping screw extending through said opening.

9. An electrical connector for connecting a cable to a battery component such as a terminal post or an intercell connector, said electrical connector comprising:

a first connector portion adapted for connection by intermetallic bond to the battery component, said first connector portion having substantially parallel upper and lower surfaces and having a post receiving opening extending between said upper and lower surfaces;

the height of said first connector portion defined between said upper and lower surfaces being less than one-half the diameter of said post receiving opening and less than one-third of the smallest dimension spanning said first connector portion in a direction parallel to said upper and lower surfaces;

a second connector portion adapted for connection to the cable, said second connector portion including a cylindrical wall defining a cable receiving socket having an axis extending transverse to and laterally spaced from the axis of said post receiving axis;

releasable clamping means mounted on said cylindrical wall for selectively securing and releasing a cable inserted into said socket;

a hub portion integrally interconnecting said first and second connector portions, said hub portion being aligned with said second connector portion, being generally tangent to said first connector portion, having an upper surface coinciding with the upper surface of said first connector portion, and having a height more than twice the height of said first connector portion;

said connector including a core structure and said first connector portion and said hub portion further including a unitary and homogeneous body of lead encapsulating said core structure;

said core structure including a tube having a first end defining said cylindrical wall of said second connector portion and a second end extending into said hub portion;

said core structure further including a ring disposed within said first connector portion and surrounding said post receiving opening;

said ring being fixed to said tube within said hub portion at a region where the plane of the ring is tangent to the tube and where the second end of the tube is adjacent the ring.

* * * * *